US005737860A

United States Patent [19]

Whigham et al.

[11] Patent Number: 5,737,860

[45] Date of Patent: Apr. 14, 1998

[54] METHOD AND APPARATUS EMPLOYING GRAVITY TO FORM A VARIABLE MESSAGE ON A SIGN

[75] Inventors: Roger Whigham; Lisa Wandrick, both of Atlanta; Thomas R. Boston, Fairburn, all of Ga.

[73] Assignee: The Coca-Cola Company, Atlanta, Ga.

[21] Appl. No.: 896,800

[22] Filed: Jul. 18, 1997

Related U.S. Application Data

[63] Continuation of Ser. No. 471,384, Jun. 6, 1995, abandoned.

[51] Int. Cl.[6] ..... G09F 13/24; B05B 17/08

[52] U.S. Cl. ..... 40/406; 40/407

[58] Field of Search ..... 40/406, 407, 439, 40/477

[56] References Cited

U.S. PATENT DOCUMENTS

| | | | |
|---|---|---|---|
| 1,221,494 | 4/1917 | Wiley . | |
| 2,308,060 | 1/1943 | De Rochefort-Lucay . | |
| 3,560,641 | 2/1971 | Taylor et al. . | |
| 3,640,463 | 2/1972 | Kawamura et al. . | |
| 3,717,945 | 2/1973 | Taylor et al. . | |
| 3,973,340 | 8/1976 | Khawand . | |
| 4,111,363 | 9/1978 | Kawamura et al. . | |
| 4,122,618 | 10/1978 | Gay . | |
| 5,340,024 | 8/1994 | Fuller et al. | 40/406 X |
| 5,363,577 | 11/1994 | Fuller et al. | 40/406 |

FOREIGN PATENT DOCUMENTS

| | | | |
|---|---|---|---|
| 1155665 | 10/1993 | Germany | 40/406 |

*Primary Examiner*—Cassandra Davis

[57] ABSTRACT

A device for forming a changeable sign from either gas bubbles rising within a body of liquid or from drops of liquid moving through the air. When using gas bubbles rising within a body of liquid, the gas bubbles are released sequentially such that a message of the sign is represented as a matrix of bubbles. When using drops of liquid moving through the air, the drops are released sequentially and controllably such that the message of the sign is represented as a matrix of drops of liquid. In one version, air bubbles are released near the bottom of a tank from controllable valves. The valves can be arranged in a single line or in a vertical matrix. As an alternative, a template having a message formed as a dot matrix is applied against a matrix of orifices from which gas escapes, to form the message. In another version, water drops are released from a row of controllable valves on a ballistic trajectory, e.g., a free-fall. As an alternative, the row of valves can be used normally to produce a continuous series of streams of water, but the streams can be interrupted while the message is produced from a dot matrix of drops.

27 Claims, 7 Drawing Sheets

FIG. 7
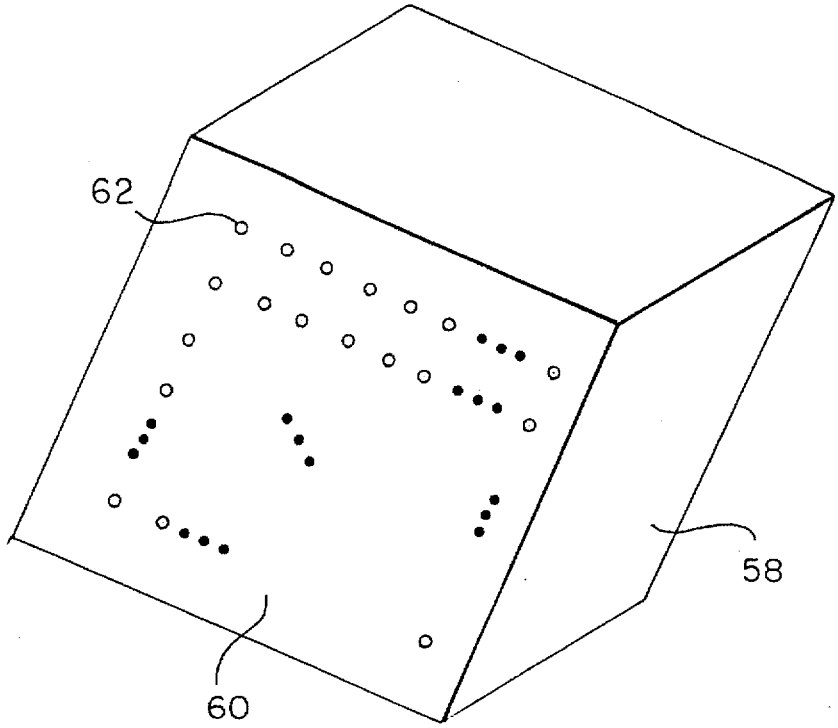
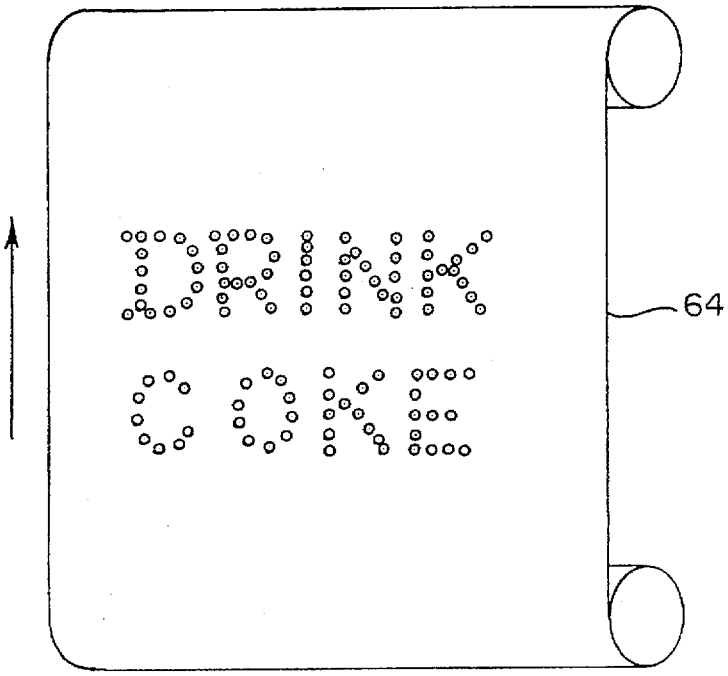
FIG. 8

METHOD AND APPARATUS EMPLOYING GRAVITY TO FORM A VARIABLE MESSAGE ON A SIGN

This application is a continuation of application Ser. No. 08/471,384 filed on Jun. 6, 1995, now abandoned.

BACKGROUND OF THE INVENTION

The present invention relates to a display device and method that employ gas or liquid to form variable messages therein. More particularly, the message is formed from gas bubbles or drops of liquid that represent a shape and/or alphanumeric characters depicted by a dot matrix of bubbles or drops, respectively.

Prior art merchandising display devices have the objective of conveying a message regarding the merchandiser's product or service. The effectiveness of such a message is roughly proportional to the amount of time that a viewer spends considering the message. A way to prolong the amount of time that a viewer considers a merchandiser's message is to present the message in a dynamically developing creative fashion; for example, skywriting. A visually arresting sign can greatly enhance the effectiveness of the message displayed.

U.S. Pat. No. 2,308,060 to de Rochefort-Lucay and U.S. Pat. No. 4,122,618 to Gay show skywriting devices which emit a plurality of individual puffs of smoke from a linear array of valved outlets which are programmed to open and close so as to produce a predetermined message. The '060 and '618 patents generally show a combination of a means to control emission of a first medium (smoke/vapor), that has a diminishing velocity whose initial velocity is non-zero, with another medium (air) to produce a legible message or display. The effect of gravity is not used to produce the message.

U.S. Pat. No. 3,640,463 to Kawamura et al. shows a water fountain that forms shapes and/or alphanumeric characters out of columns of water. The fountains of the '463patent are intended to be viewed from an elevation significantly above the fountain, e.g., overhead. FIG. 9 shows an array of controllable nozzles for forming shapes and/or alphanumeric characters via dot matrix representation, under the control of the control circuit of FIG. 10. Each dot in the matrix corresponds to a column of water. The message to be displayed is stored on a stencil as in FIG. 11 which is read by the reader of FIG. 12. The effect of gravity precludes the '463 patent's fountains from being legible to an observer from any position other than at an elevation significantly above the fountain, e.g., overhead.

U.S. Pat. No. 4,111,363 to Kawamura et al. shows an improvement upon the '463 patent. The jets that form the columns of water are tiered so as to make the display legible to an observer that is not necessarily elevated above the fountain.

U.S. Pat. No. 1,221,494 to Wiley shows a sign formed by blowing flakes, shreds or chips, or other light particles through a vertical stencil in continuous streams. The effect of gravity destroys rather than produces the message of the sign.

U.S. Pat. No. 3,973,340 to Khawand shows a set of closely spaced vertical tubes. Through those tubes are passed immiscible fluids. Shapes and/or alphanumeric characters are formed by selectively alternating the fluids, such that a message is formed out of a first fluid contrasted with a second background fluid. The effect of gravity is used to produce the sign, in conjunction with the necessary fluid confinement within the tubes.

U.S. Pat. No. 3,717,945 to Taylor et al. and U.S. Pat. No. 3,560,641, also to Taylor et al. show an arrangement for producing variable 3-dimensional displays. It involves an electrostatic system that permits certain drops of fluid to fall while other drops are diverted to a collector using electrostatic forces. The system employs stroboscopic flash lamps that are used to illuminate a pattern of falling drops and essentially "fix" the pattern in space insofar as an observer is concerned, due to the phenomena of persistence of vision. Whether a falling drop is made visible to an observer is determined by whether it is allowed to pass unaffected through the deflection electrodes 44 FIG. 1 or is deflected by the deflection electrodes into a catcher unit 45 so as to be prevented from falling into the viewing area.

None of these prior art devices take full advantage of the relative motion effects of gravity on fluid particles of different respective densities and an observer's likely fascination with the phenomenon of air bubbles rising within water, or water droplets falling through air.

SUMMARY OF THE INVENTION

It is an object of the present invention to provide a method and apparatus for forming a visually arresting sign.

It is an object of the present invention to provide a method and apparatus for using gravity to form a visually arresting sign, for a merchandising device, whose message is variable and dynamically formed.

As a further object of the invention to provide a method and apparatus using gravity to form a visually arresting sign whose message is variable and is represented by a dot matrix of gas bubbles or drops of liquid, respectively, that represent shapes and/or alphanumeric characters. The embodiments that employ gas bubbles rising within a liquid take advantage of a person's normal fascination with air bubbles rising within water to prolong the length of time that an observer concentrates upon the sign. The embodiments directed toward forming a sign out of drops of liquid moving through the air take advantage of a person's lifelong sensual appreciation of dripping water, and to a similar extent, a person's fascination with the natural beauty of waterfalls.

A first embodiment of the present application fulfills objectives of the present invention, i.e., forming a changeable message on a sign from gas bubbles rising within a body of liquid, by:

- releasing sequentially a plurality of bubble groups within the body of liquid;
  - each bubble group including at least one gas bubble;
  - the message of the sign being represented as a matrix of dots;
    - each dot of the matrix being a gas bubble;
  - each bubble group corresponding to a row of the dot matrix;
  - the gas being less dense than the liquid such that bubbles rise uniformly under gravity's effect.

An exemplary apparatus corresponding to the first embodiment includes:

- a body of liquid;
- a source of the gas;
- a plurality of controllable valves, connected to the source of gas, and arranged to release gas into the body of liquid;
- a controller for controlling the valves to selectively open such that the gas is released from each selected valve to form a bubble in the liquid, thus forming a bubble group;

the controller releasing sequentially a plurality of bubble groups within the body of liquid;

each bubble group including at least one gas bubble;

a message of the sign being represented as a matrix of dots;

each dot of the matrix being a gas bubble;

each bubble group corresponding to a row of the dot matrix;

the gas being less dense than the liquid such that the bubbles rise uniformly under gravity's effect.

A second embodiment of the present application satisfies objectives of the present invention, i.e., forming a changeable message on a sign from gas bubbles rising within a body of liquid, and includes:

a body of liquid;

a source of the gas;

a plurality of controllable valves, each valve having an orifice, the orifices being arranged in a matrix, the valves being connected to the source of gas, and further arranged to release gas into the body of liquid;

a controller for controlling the valves to selectively open such that the gas is released from each selected valve to form a matrix of bubbles in the liquid, thus forming a bubble group;

the message of the sign being represented as a matrix of dots wherein the dots are bubbles;

the orifice matrix being of sufficient dimension such that a bubble group can form at least one row of alphanumeric characters;

the gas being less dense than the liquid such that a row rises uniformly under gravity's effect.

A third embodiment of the present application fulfills the objectives of the present invention, i.e., forming a changeable message on a sign from gas bubbles rising within a body of liquid, and includes:

a body of liquid;

a source of the gas;

a gas chamber; connected to the source of gas;

the gas chamber having a first surface with a plurality of apertures therein through which the gas escapes, the surface being substantially vertical and flat;

the plurality of apertures being arranged in a matrix;

a stencil, disposed against the first surface such that the matrix of apertures is sealed;

the stencil having a plurality of apertures therein disposed in a matrix such that the stencil's apertures permit gas to escape from the gas chamber when aligned with the first surface's apertures;

the stencil's matrix being arranged to represent alphanumeric characters;

gas escaping as bubbles from aligned stencil and first surface apertures forming a alphanumeric bubble matrix characters of the sign.

A fourth embodiment of the present application fulfills objectives of the present invention, i.e., forming a changeable message on a sign from drops of liquid moving through the air, by:

releasing sequentially and controllably, from controllable valves, a plurality of groups of the drops into the air, the drops following a ballistic trajectory;

each group of drops including at least one drop of liquid;

the message of the sign being represented as a matrix of dots;

each dot of the matrix being a drop of the liquid;

each group of drops corresponding to a row of the dot matrix;

a set of the groups of dots, as a whole, forming at least one alphanumeric character discernable by a viewer.

An exemplary apparatus corresponding to the fourth embodiment, for forming a changeable sign from drops of liquid moving through the air, includes:

a source of the liquid;

a plurality of controllable valves, connected to the source of liquid, and arranged to release the liquid;

a controller for controlling the valves to selectively open such that the liquid is released from each selected valve to form a drop;

the controller releasing sequentially a plurality of groups of the drops into the air, the drops following a ballistic trajectory;

each group of drops including at least one drop of liquid;

the message of the sign being represented as a matrix of dots;

each dot of the matrix being a drop of the liquid;

each group of drops corresponding to a row of the dot matrix;

a set of the groups of dots, as a whole, forming at least one alphanumeric character discernable by a viewer.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 7 depicts in greater detail the gas chamber of the embodiment of FIG. 7;

FIG. 8 depicts an alternative arrangement of the scrolled stencil of the FIG. 6 embodiment;

DETAILED DESCRIPTION OF THE PREFERRED EMBODIMENTS

Figure 1:
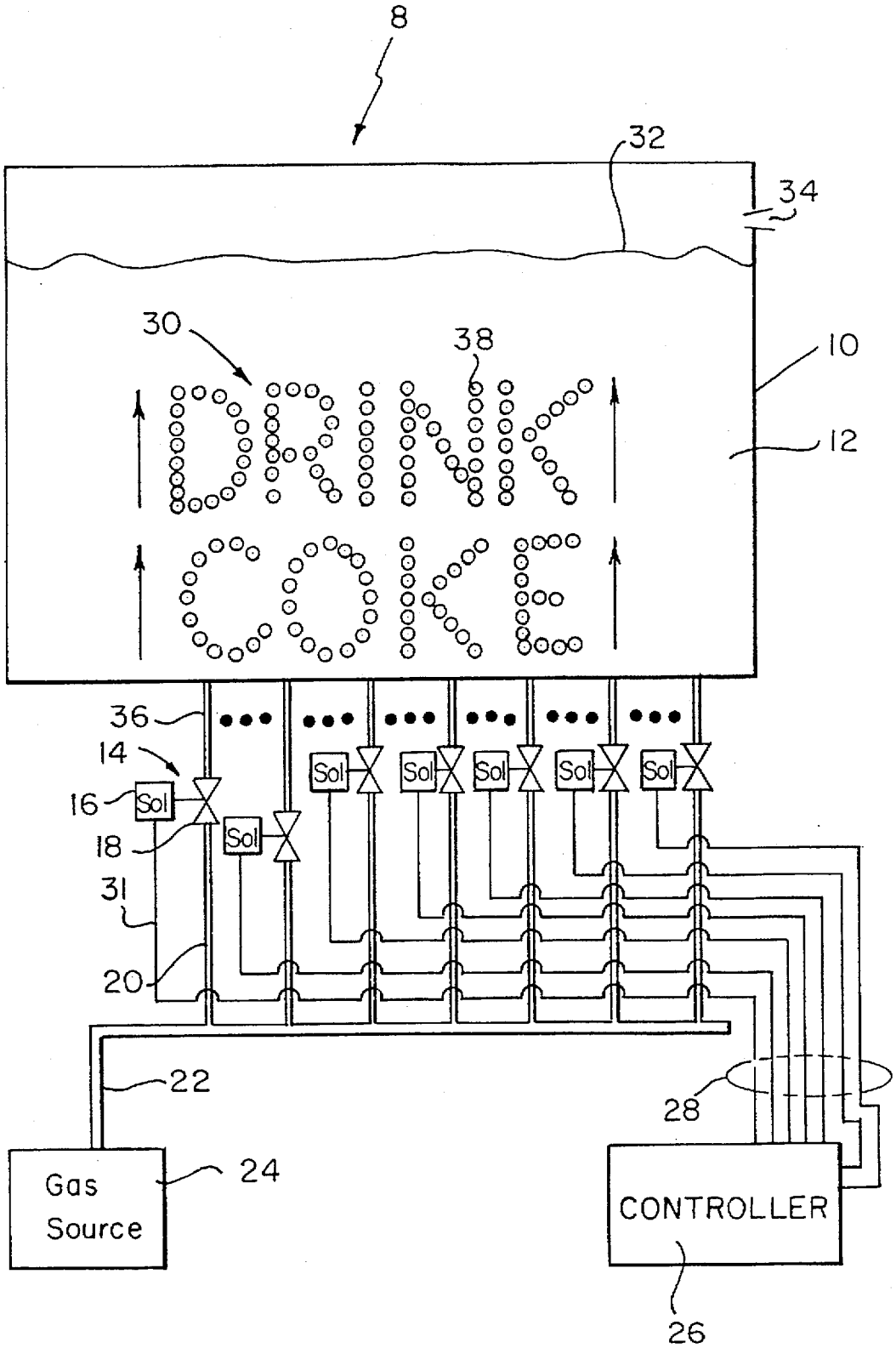
FIG. 1 is a diagrammatic view depicting a first embodiment of the present invention that forms a changeable message on a sign from gas bubbles rising within a body of liquid.

A first embodiment of a display device 8 for forming a changeable message from gas bubbles rising within a body of liquid, associated with a merchandising device, is depicted in FIG. 1. The changeable message depicted in FIG. 1 is "DRINK COKE", where the term "COKE " is a registered trademark of the Coca-Cola. A tank 10 contains liquid 12. The tank 10 has a vent 34 leading to the atmosphere. Bubbles 38 are grouped together as a bubble matrix 30. As the bubble matrix 30 rises within the liquid 12 toward the surface 32 of the liquid, a shape or message of alphanumeric characters becomes discernable by an observer. The message incrementally dissipates, or disappears as the bubbles reach surface 32.

A plurality of solenoid valves 14 are connected to the tank by air jets 36. In actuality, there would be significantly more solenoid valves than are depicted in FIG. 1, FIG. 1 having been simplified for clarity of illustration. Each solenoid valve 14 includes a valve 18 and a solenoid 16.

A valve 18 is connected to a valve supply line 20 which is connected to a main supply line 22 through which gas passes from the gas source 24. A controller 26 is connected to the solenoid valves by a plurality of solenoid control lines 28. In other words, each solenoid 16 is connected to the controller 26 by its own solenoid control signal line 31.

The gas source 24 may include components that are well-known in the art, for example, a gas reservoir connected to a pump driven by an electric motor. The depth of the water within the tank is preferably sufficient such that an observer can concentrate upon the shape and/or message formed for a sufficient amount of time to ensure that the message is visibly discernible.

The controller can take the form of a computer, running a program, connected to the solenoid control line 28 via an electrical interface or an electro-optical interface connected to a set of electronic drivers. Alternatively, the controller can take the form of discrete electronic logic components or a combination of discrete electronic logic components and opto-electronic components. In particular, the formation of alphanumeric characters and shapes is analogous to the techniques used in the dot matrix printing art and related ink jet and laser printing arts.

Figure 2:
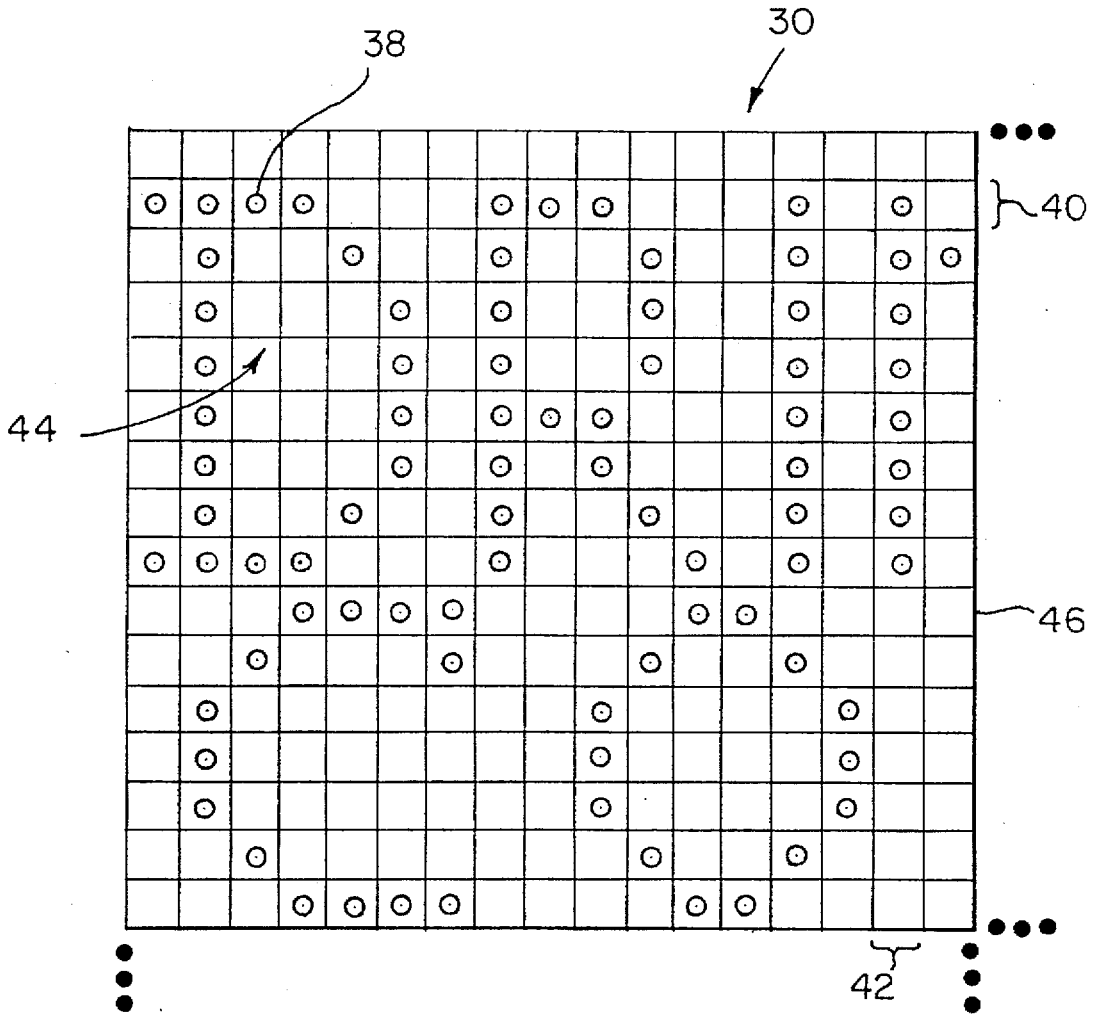
FIG. 2 depicts in greater detail the bubble message of FIG. 1 formed within an imaginary grid defining a dot matrix display field.

FIG. 2 depicts the bubble matrix 30 in greater detail. An imaginary grid 46 is superimposed upon the bubble matrix 30 for purposes of explanation, in order to demonstrate the analogy to a dot matrix display field. The imaginary grid 46 includes rows 40 and columns 42. The alphanumeric character 44 corresponds to the letter "D".

The operation of the apparatus of FIG. 1 will now be described. The controller 26 sequentially releases a plurality of bubbles into the liquid 12 in the tank 10. Each plurality of bubbles released can be referred to as a group, and each such bubble group represents a row 40 in the bubble matrix 30. A message is represented in dot matrix form by the bubble matrix 30, with each bubble acting as a dot.

A gas that is less dense than the liquid is chosen so that the bubbles rise uniformly under gravity's effect. The upward flow of the bubbles is preferably laminar. The gas forming the bubbles 38 is preferably air while the liquid 12 is preferably water. Further, the viscosity of the liquid 12 should be high so that the rate at which the gas bubbles 38 rise is slow. The slower the rate at which the gas bubbles 38 rise within the liquid 12, the more easily an observer can discern the message represented by the bubble matrix 30. In addition, the refractivity and reflectivity of the gas and liquid are chosen to maximize a person's ability to distinguish visually the bubbles rising within the liquid.

At least the obverse surface of the tank 10 is transparent. The bubbles are preferably released near or at the bottom of the liquid in order to maximize the distance that the bubbles can rise. By maximizing this distance, the observation time is maximized.

Figure 3:
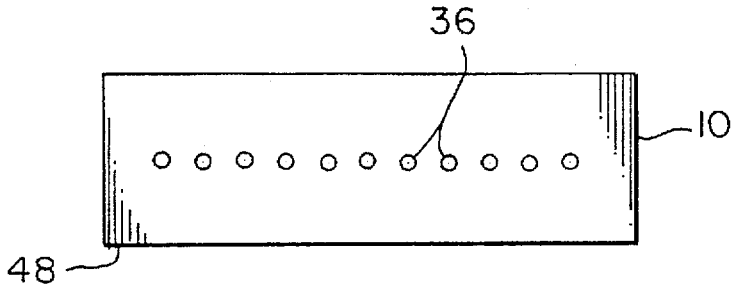
FIG. 3 depicts in greater detail the arrangement of valves in the FIG. 1 embodiment.
Figure 4:
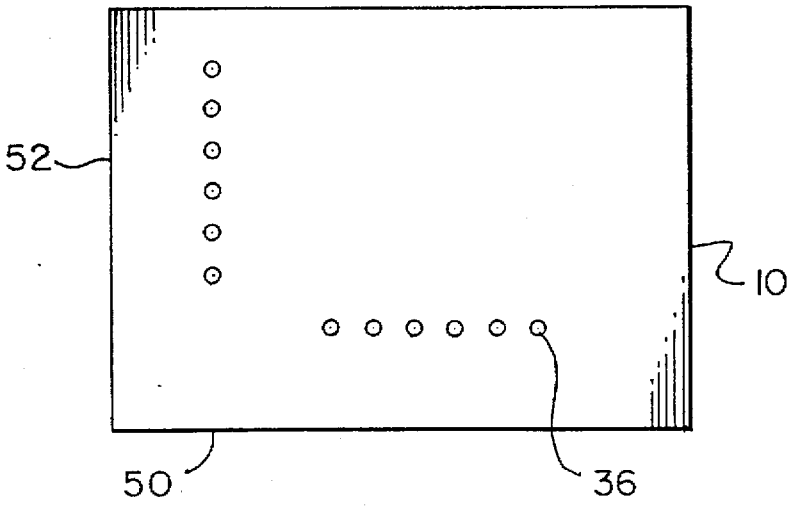
FIG. 4 depicts an alternative arrangement of valves in the FIG. 1 embodiment.

FIG. 3 depicts an overhead view of an arrangement of the air jets 36 within the tank 10. The air jets 36 are arranged in a line parallel to the obverse surface 48 of the tank 10. Similarly, FIG. 4 depicts another overhead view of an alternative arrangement of the air jets 36 within the tank 10. A first line of air jets 36 is arranged parallel to a first obverse surface 50 while a second line of air jets 36 is arranged parallel to a second obverse surface 52.

In general, any vertical surface obverse to an observer can have a parallel line of jets arranged in relation thereto. One must be careful in considering lines of air jets that are parallel to one another, i.e., across the tank. An observer on one side of the tank would be able to see the bubbles rising on the other side of the tank, which could lesson the discernability of the bubble matrix immediately in front of the observer, depending upon the distance between the parallel lines of air jets.

Figure 5:
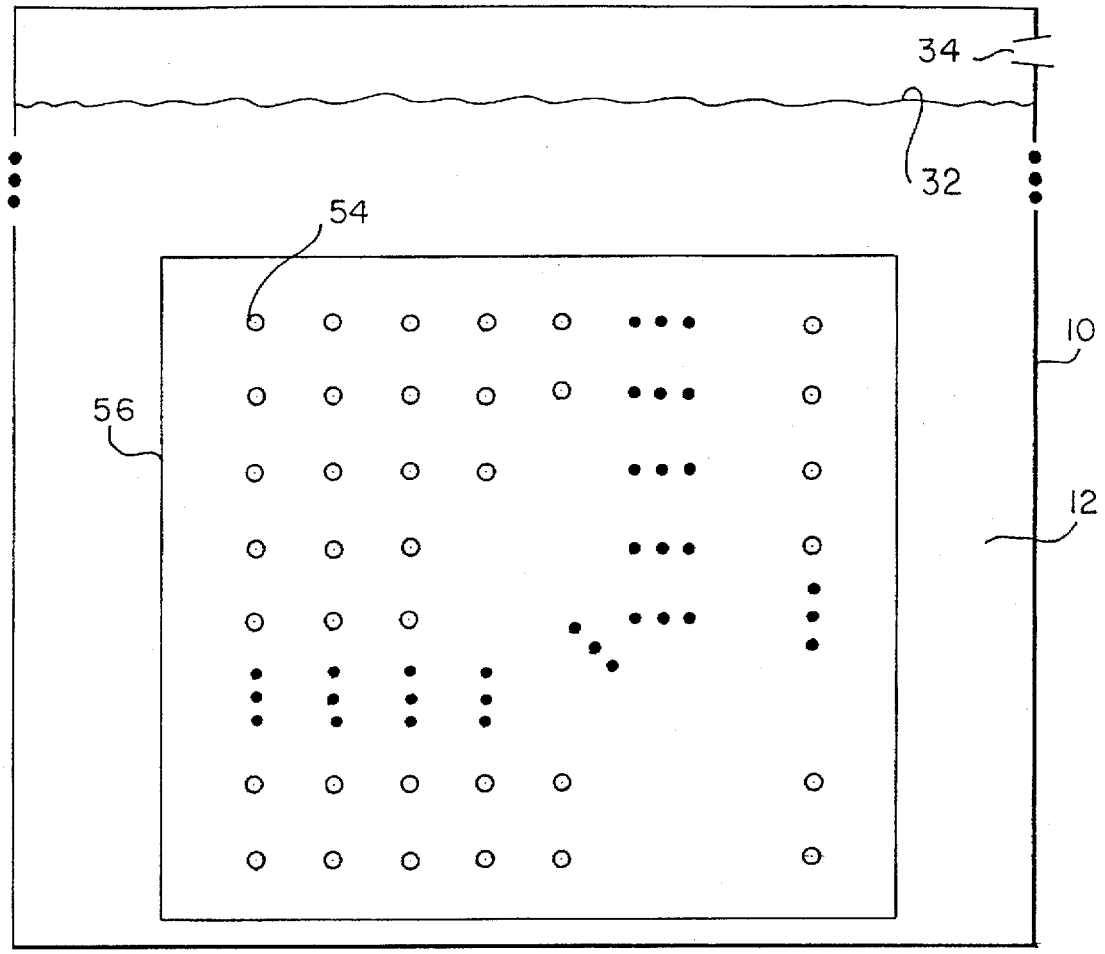
FIG. 5 is a front elevational view of a portion of a second embodiment of the present invention that forms a changeable message from gas bubbles rising within a body of liquid.

FIG. 5 depicts a second embodiment of an apparatus performing a changeable sign from gas bubbles rising within a body of liquid. Only the differences between the second embodiment depicted in FIG. 5 and the first embodiment depicted in FIG. 1 will be discussed. In FIG. 5, a matrix 56 of orifices 54 is positioned within the liquid 12 contained within the tank 10. An orifice 54 is connected to its own solenoid valve 14 (not shown in FIG. 5).

A controller 26 (not shown in FIG. 5) differs from that shown in FIG. 1 by having to control a two-dimensional array of solenoid valves rather than a single row of solenoid valves. In operation, the embodiment depicted in FIG. 5 can produce whole shapes and/or alphanumeric characters at one time rather than assembling a shape and/or an alphanumeric character one row at a time.

Figure 6:
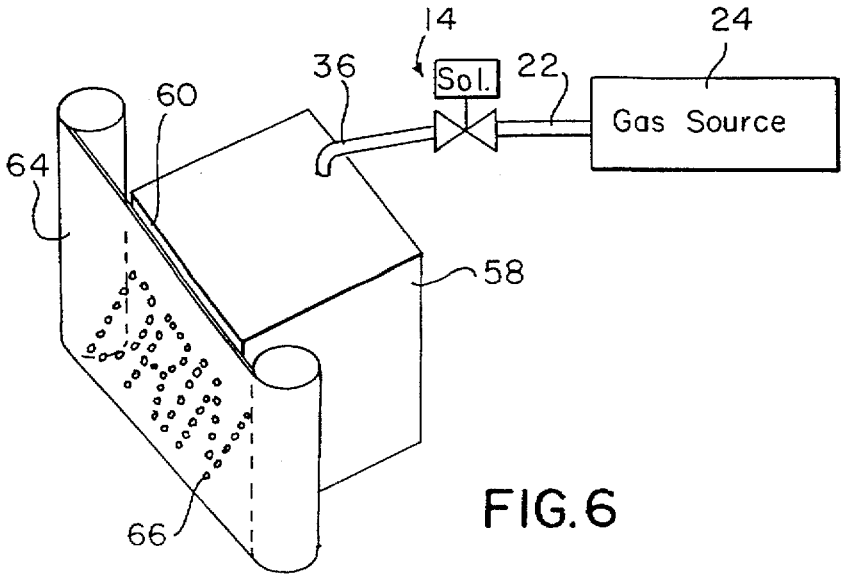
FIG. 6 is a diagrammatic view depicting a third embodiment of the present invention that forms a changeable message from gas bubbles rising within a body of liquid.

FIG. 6 depicts a third embodiment for forming a changeable sign from gas bubbles rising within a body of liquid. A gas source 24 is connected to a solenoid 14 by a main supply line 22. A gas jet 36 connects the solenoid 14 to gas chamber 58. Gas chamber 58 has a front face 60 (to be discussed below in connection with FIG. 7). Against the front face 60 is arranged a scrolled stencil 64. The stencil 64 is semi-flexible so as to permit it to be scrolled.

A dot matrix representation of a shape and/or alphanumeric characters is formed into the stencil 64 by apertures 66, i.e., and aperture 66 acts as a dot in the dot matrix. FIG. 7 depicts the gas chamber 58 in more detail. The front surface 60 of the gas chamber 58 has apertures 62 that form a matrix of apertures. When the scrolled stencil 64 is positioned against the matrix of apertures 60, i.e., the front face, then apertures 62 in the front face 60 are selectively uncovered by apertures 66 in the scroll stencil 64.

The stencil 64 can be scrolled horizontally across the front face 60 as depicted in FIG. 6, or can be scrolled vertically across the front face 60 of the gas chamber 58 as depicted in FIG. 8. In the instance in which the stencil is scrolled vertically across the front face 60 of the gas chamber 58, the matrix of apertures in the front face 60 can be a one-dimensional row.

If the size of the front face's 60's matrix of apertures is significant, then the size its apertures 62 and/or the apertures 66 in the stencil 64 should be selected as a function of the aperture's depth in the liquid relative to the other apertures such that the gas bubbles appear uniformly size while rising. In other words, the lower the depth at which a gas bubble is released, the larger the gas bubble should be initially. Such a determination is within the ordinary level of skill in the art taking into consideration Boyle's Law and the pressure of the liquid as a function of depth. Alternatively, instead of adjusting the size of the orifice, the duration that the solenoid valve is open could be adjusted as a function of depth wherein the longer the valve is opened, the greater the volume of gas that will be released.

An alternative arrangement of the third embodiment involves permanently drilling the matrix of holes in the backside of the gas chamber. By pulsing the solenoid valve, gas bubbles are emitted to form the shape and/or alphanumeric characters which the aggregate of the holes represents.

Figure 9:
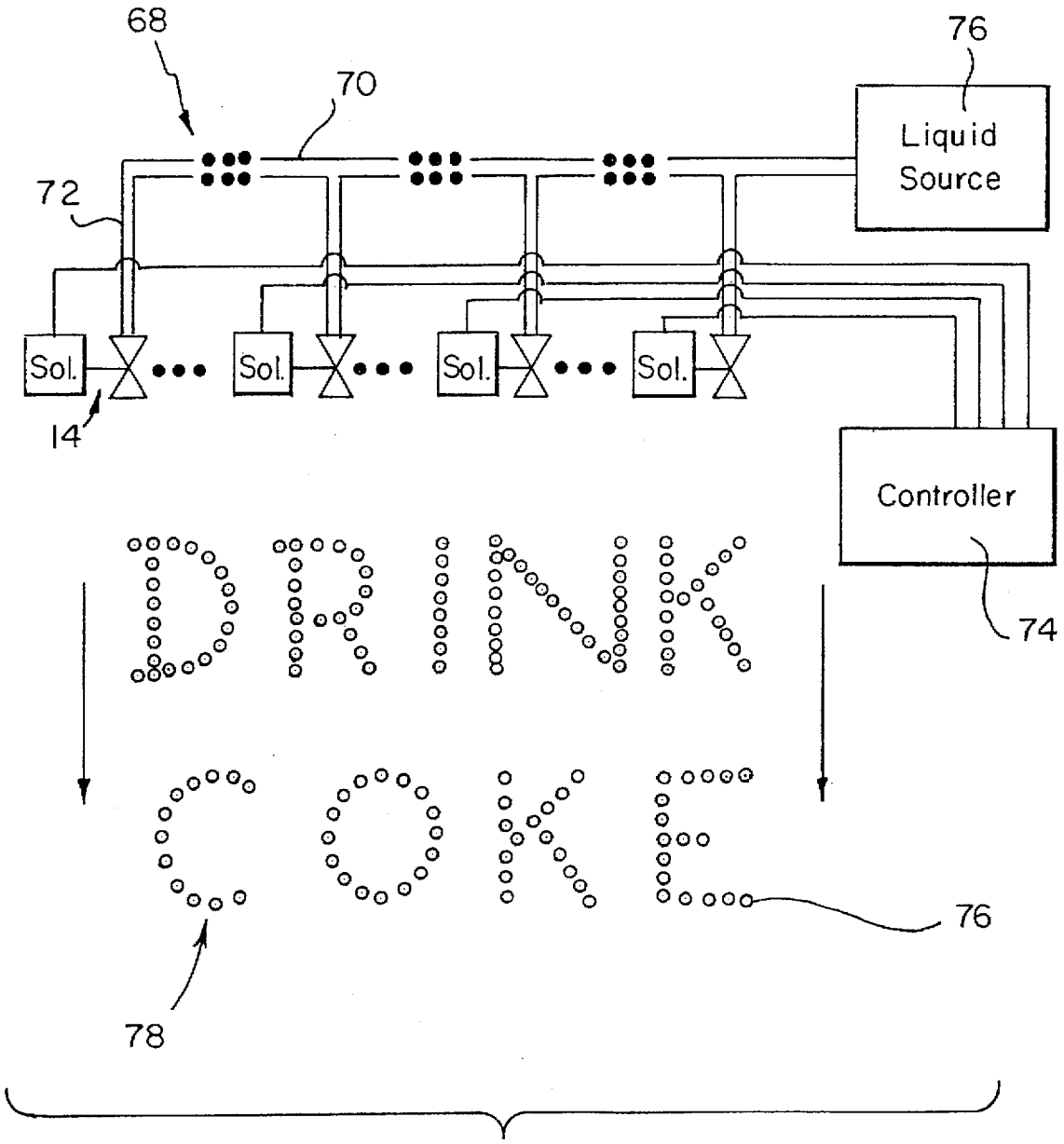
FIG. 9 is a diagrammatic view depicting a fourth embodiment of the present invention that forms a changeable message from drops of liquid moving through the air.

FIG. 9 depicts a fourth embodiment for forming a changeable sign from drops of liquid moving through the air. A source of liquid 76 is connected to the main supply line 70. Each of valve supply lines 72 is connected to the main supply line 70 as well as to its respective solenoid valve 14. In actuality, there would be significantly more solenoid valves than are depicted in FIG. 9, FIG. 9 having been simplified for clarity of illustration.

The drops 76 being released from the solenoid valves 14 collectively form a drops-of-liquid matrix 78 that displays shapes and/or alphanumeric characters. FIG. 9 illustrates the circumstance in which the ballistic trajectory of the drops is simply a free-fall from the solenoid valves.

Figure 10:
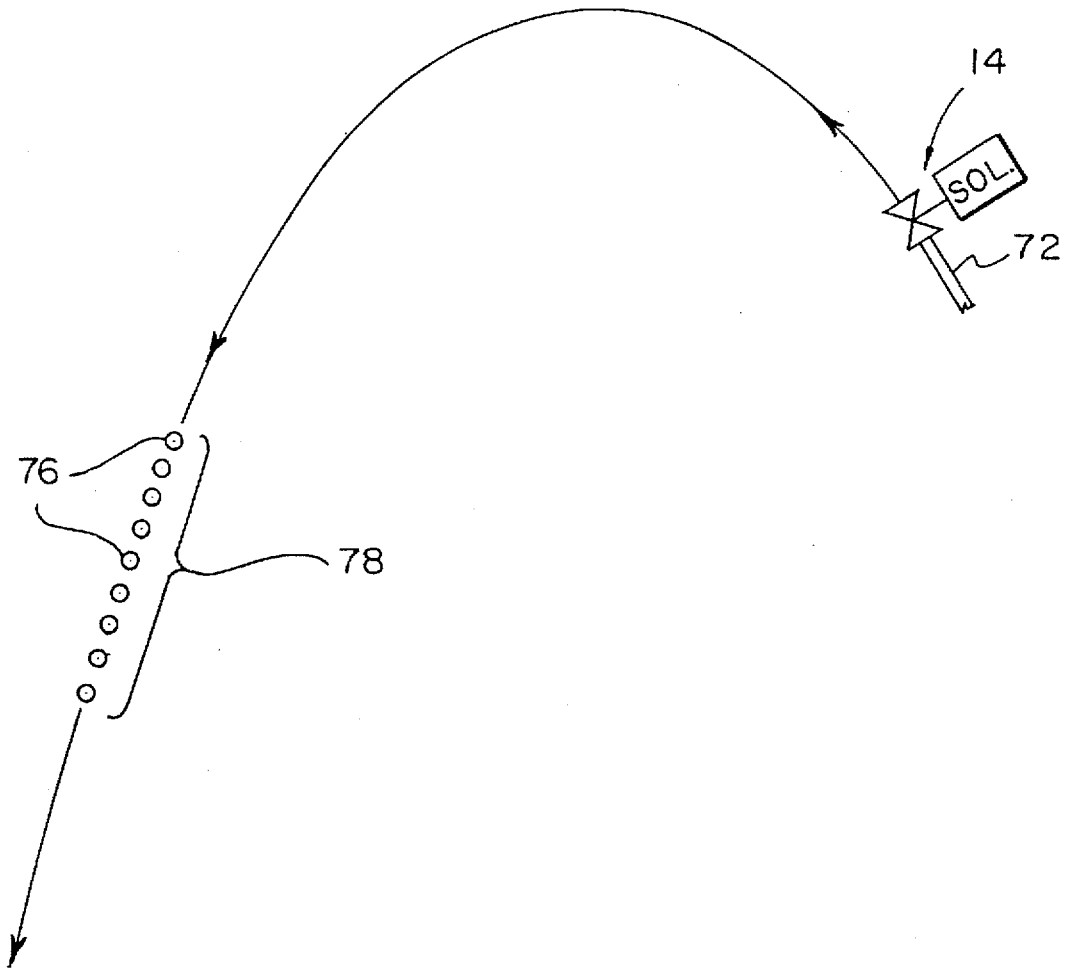
FIG. 10 depicts an alternative orientation of the solenoid valves of the embodiment depicted in FIG. 9.

An alternative embodiment is depicted in FIG. 10. In FIG. 10, the drops are released along a ballistic trajectory.

In operation of the embodiment of FIG. 10, groups of drops are sequentially released from the solenoid valves 14 into the air, the drops free-falling (a particular example of a ballistic trajectory). As with the path of the gas bubbles in the preceding embodiments, the trajectory of the dots in this embodiment is preferably laminar. The liquid is preferably water, and may be colored to enhance visibility.

Preferably, the distance that the groups of drops fall, either from the apex of the ballistic projectary, or from the solenoid valves in the case of a free-fall, should be sufficient such that an observer can concentrate his attention on the shape or alphanumeric characters formed by the drops-of-liquid matrix for a minimal amount of time.

The controller 74 for the fourth embodiment is very similar to the controller discussed in the preceding embodiments, and, thus, well within the level of ordinary skill in the art. In addition to only releasing drops such that shapes and/or alphanumeric characters are represented, the controller can also operate the solenoid valves to create a conventional waterfall. The controller can cause a message and/or shape to appear randomly and/or periodically. If the shape and/or message is controlled to appear randomly, people will watch the waterfall in anticipation.

An alternative embodiment of the sign formed by drops of liquid moving through the air involves the use of colored oil and water. The colored oil is used to deliver the message. Because oil and water do not mix, the oil could be separated from the water and reused.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A method of forming a moving and changeable non-coded message in a substantially vertical display field, the display field having a plurality of positions at different heights, the method comprising the steps of:

providing a tank of a liquid in which is located the display field;

providing a source of gas;

sequentially forming said gas at multiple locations within said tank into shapes so as to form portions of said non-coded message; and combining the shapes of said gas with the liquid, within the display field under an effect of gravity, to establish said shapes of said gas at different relative height positions within said display field, such that the non-coded message is intelligible from a total visual relationship between said different relative height positions of said shapes within said display field as observed from a side of said tank.

2. A method as in claim 1, wherein:

the non-coded message is at least one of a pictorial illustration and at least one alphanumeric character.

3. A method as in claim 1, wherein: the gas is air and the liquid is water.

4. An apparatus for forming a moving and changeable non-coded message in a substantially vertical display field of a first medium, the display field having a plurality of positions at different heights, the apparatus comprising:

a tank of liquid in which is located the display field;

a source of gas;

shaping means, operatively connected to the source, for sequentially forming the gas at multiple location within said tank into shapes so as to form portions of the non-coded message; and a controller, operatively connected to the shaping means, for controlling the shaping means to combine the shapes of the gas with the liquid, within the display field under an effect of gravity, so as to establish said shapes of the gas at different relative height positions within said display field such that the non-coded message is intelligible from a total visual relationship between said different relative height positions of said shapes within said display field as observed from a side of said tank.

5. An apparatus as in claim 4, wherein:

the non-coded message is at least one of a pictorial illustration and at least one alphanumeric character.

6. An apparatus as in claim 4, wherein: the gas is air and the liquid is water.

7. A method of forming a substantially vertical, moving and changeable message for a sign from gas bubbles rising within a tank of liquid, comprising the steps of:

sequentially releasing gas as a plurality of bubble groups within the tank of liquid, bubbles in each of said bubble groups corresponding to multiple locations within said tank, to establish said plurality of bubble groups at different relative depths within said tank of liquid such that a message is intelligible from a total visual relationship between the different relative depths of said bubble groups within said tank of liquid as observed from a side of said tank each bubble group including at least one gas bubble defining part of the message;

the gas of each of said plurality of bubble groups being less dense than the liquid such that each of said plurality of bubble groups rises uniformly under an effect of gravity.

8. A method as in claim 7, wherein:

the message of the sign is represented as a matrix of dots; each dot of the matrix being a gas bubble;

each bubble group corresponding to a row of the dot matrix.

9. A method as in claim 7, wherein the gas is air and the liquid is water.

10. A method as in claim 7, wherein:

the liquid is of a higher viscosity than water such that a rate at which the gas bubbles rise is slower than if in water.

11. A method as in claim 7, wherein:

the tank has a bottom and the bubble groups are released at the bottom of the tank of liquid.

12. A method as in claim 7 wherein:

the gas and liquid are chosen to maximize an observer's ability to visually distinguish a bubble within the liquid.

13. A method as in claim 7, wherein:

the message is at least one of a pictorial illustration and at least one alphanumeric character.

14. An apparatus for forming a moving and changeable message for a sign from gas bubbles rising within a body of liquid, comprising:

a body of liquid;

a source of the gas;

a plurality of controllable valves, connected to the source of gas, and arranged to release the gas into the body of liquid;

a controller for controlling the valves to selectively open such that the gas is released from each selected valve to form a gas bubble in the liquid, thus forming a bubble group;

the controller being operative to sequentially release said plurality of bubble groups within the body of liquid to establish said plurality of bubble groups at different relative depths within said body of liquid such that a message is intelligible from a total visual relationship between the different relative depths of said bubble groups within said body of liquid;

each bubble group of said plurality of bubble groups including at least one gas bubble defining part of said message;

the gas of each of said plurality of bubble groups being less dense than the liquid such that each of said plurality of bubble groups rises uniformly under an effect gravity.

15. An apparatus as in claim 14, wherein:

the message of the sign is represented as a matrix of dots; each dot of the matrix being one of the gas bubbles; each bubble group corresponding to a row of the dot matrix.

16. An apparatus as in claim 14, wherein:

the controllable valves are solenoid valves.

17. An apparatus as in claim 14, wherein the gas is air and the liquid is water.

18. An apparatus as in claim 14, wherein:

the liquid is of high viscosity such that a rate at which the gas bubbles rise is slow.

19. An apparatus as in claim 14, wherein:

the body of liquid is contained within a vented tank, at least an obverse surface of the tank being clear.

20. An apparatus as in claim 14, wherein:

the bubble groups are released at a bottom of the body of liquid.

21. An apparatus as in claim 14, wherein:

the gas and liquid are chosen to maximize an observer's ability to distinguish visually each said gas bubble within the liquid.

22. An apparatus as in claim 14, wherein:

the plurality of controllable valves is located within the liquid.

23. An apparatus as in claim 14, wherein:

the message is at least one of a pictorial illustration and at least one alphanumeric character.

24. The method as in claim 7, further comprising:

forming a phrase having at least a first word positioned above a second word by selectively changing the changeable message to successively correspond to the first word and then the second word.

25. An apparatus as in claim 14, wherein the controller is operable to form a phrase having at least a first word positioned above a second word by selectively changing the changeable message to successively correspond to the first word and then the second word.

26. The method as in claim 24, further comprising:

forming only said first word over said second word.

27. An apparatus as in claim 25, wherein the controller is operable to form only said firstr word over said second word.

* * * * *